US005216960A

United States Patent [19]

Kuchler

[11] Patent Number: 5,216,960

[45] Date of Patent: Jun. 8, 1993

[54] HOLDER FOR AUTOMATIC SLICING MACHINE

[76] Inventor: Fritz Kuchler, Klatteweg 4, A-9410 Klagenfurt, Austria

[21] Appl. No.: 888,751

[22] Filed: May 21, 1992

[30] Foreign Application Priority Data

May 21, 1991 [AT] Austria ..... 1033/91

[51] Int. Cl.[5] ..... B26D 7/06

[52] U.S. Cl. ..... 83/74; 83/360; 83/415; 83/713; 83/721

[58] Field of Search ..... 83/42, 77, 88, 72, 74, 83/360, 365, 412, 415, 713, 721, 452

[56] References Cited

U.S. PATENT DOCUMENTS

| | | | |
|---|---|---|---|
| 3,515,190 | 6/1970 | Moriuchi | 83/77 |
| 3,906,829 | 9/1975 | Westfall | 83/713 |
| 4,015,494 | 4/1977 | Spooner | 83/77 |
| 4,379,416 | 4/1983 | Kuchler | 83/360 |
| 4,543,868 | 10/1985 | Maurer et al. | 83/713 |
| 4,598,618 | 7/1986 | Kuchler | 83/713 |

*Primary Examiner*—Frank T. Yost
*Assistant Examiner*—Scott A. Smith
*Attorney, Agent, or Firm*—Herbert Dubno; Andrew Wilford

[57] ABSTRACT

An apparatus for cutting slices from a foodstuff has a support, a blade on the support extending perpendicular to and rotatable about an axis, and a table adapted to support the foodstuff to be sliced. The table is reciprocated transversely of the axis past the blade and the foodstuff is synchronously periodically shifted on the table axially toward the blade. A guide rail extends transversely of the axis immediately adjacent the blade and carries a holding arm engageable with the foodstuff on the table and displaceable along the rail in a forward direction to press the foodstuff against the table and in an opposite reverse direction. Interengaging formations on the rail and arm prevent movement of the arm in the reverse direction on the guide rail, and a drive including an electric motor connected to the arm displaces same on the rail in the forward direction and disengages the formations and displaces the arm on the rail in the reverse direction. Thus a controller connected to the drive and shifting devices can reverse displace the holding arm during shifting of the foodstuff toward the blade. In this manner the foodstuff is held immediately adjacent the blade during each slicing operation, and then is released and advanced, before it is held again for the next slice.

9 Claims, 1 Drawing Sheet

HOLDER FOR AUTOMATIC SLICING MACHINE

FIELD OF THE INVENTION

The present invention relates to a slicing machine. More particularly this invention concerns such a slicing machine that automatically slices up a foodstuff workpiece.

BACKGROUND OF THE INVENTION

A standard slicing machine has an input table that can be reciprocated longitudinally past a normally circular rotating blade to cut slices from a foodstuff, for instance a piece of meat or cheese, sitting on the input table. On the other side of the blade the slices are picked up by a conveyor, typically a fork-, belt-, or chain-type arrangement having a vertical support plane and provided with a multiplicity of sharp points so that the slices can be caught on the conveyor as they issue from the downstream side of the blade. A transfer fork has tines engaged between adjacent elements of the conveyor and can be pivoted to pull the slices off the conveyor and deposit them on an output table which is positioned horizontal underneath the downstream side of the blade. Thus as the input table is moved back and forth, slices are cut from the foodstuff thereon, these slices pass the blade and are picked up the conveyor, and the transfer fork deposits them in a stack on the output table. Such machines are described in detail in my earlier U.S. Pat. Nos. 4,185,527, 4,217,650, 4,338,836, 4,379,416, 4,586,409, 4,598,618, 4,763,738, and 4,867,257.

In the standard system the foodstuff is held down on the input table by a pivotal holddown arm that is spring loaded to press the foodstuff down against the input table. Thus the foodstuff is retained on the table by this holddown assembly. This holddown assembly is spaced some distance from the cutting plane defined by the cutting blade and the end plate that is coplanar with the edge of this blade. Hence at the start of an operation reducing a foodstuff to slices substantially the entire length of the foodstuff projects from the holddown assembly to the blade plane. Only near the end of the cutting operation is this assembly reasonably close to the blade plane.

Some foodstuffs, for instance soft cheeses or worsts are fairly soft so that as they rub against the end plate they are deformed substantially. As a result the cut is not square and elliptical pieces are cut from a circular-section foodstuff and rectangularly elongated pieces from a square-section foodstuff. This is not generally considered satisfactory.

Thus it is known in manually fed slicing machines to provide a holddown immediately adjacent the blade plane on the input table. This secondary holddown must be specifically adjusted relative to the foodstuff being sliced, and also must be readjusted periodically so it does not get caught by the blade. Such an arrangement is not usable on a slicing machine with an automatic feed.

OBJECTS OF THE INVENTION

It is therefore an object of the present invention to provide an improved automatic slicing machine.

Another object is the provision of such an improved automatic slicing machine which overcomes the above-given disadvantages, that is which ensures that the foodstuff is cut square even when it is fairly soft.

SUMMARY OF THE INVENTION

An apparatus for cutting slices from a foodstuff has according to the invention a support, a blade on the support extending perpendicular to and rotatable about an axis, and a table adapted to support the foodstuff to be sliced and displaceable transversely of the axis past the blade. The table is reciprocated transversely of the axis past the blade and the foodstuff is synchronously periodically shifted on the table axially toward the blade. A guide rail extends transversely of the axis immediately adjacent the blade and carries a holding arm engageable with the foodstuff on the table and displaceable along the rail in a forward direction to press the foodstuff against the table and in an opposite reverse direction. Interengaging formations on the rail and arm prevent movement of the arm in the reverse direction on the guide rail, and a drive including an electric motor connected to the arm displaces same on the rail in the forward direction and disengages the formations and displaces the arm on the rail in the reverse direction.

Thus with the system of this invention it is possible for a controller connected to the drive and shifting devices to reverse displace the holding arm during shifting of the foodstuff toward the blade. In this manner the foodstuff is held immediately adjacent the blade during each slicing operation, and then is released and advanced, before it is held again for the next slice. The result is that the foodstuff workpiece will be cut into perfectly uniform slices, circular ones for cylindrical foodstuffs and square ones for parallepipedal foodstuffs.

According to a feature of the invention the guide rail extends generally horizontally above the table and the holding arm projects downward from the guide rail. The table normally has a vertical flange so that in this case the foodstuff workpiece is pinched between two vertical surfaces. It is also possible to set the guide rail vertical and the arm horizontal for pinching the foodstuff against the upper face of the table, or to set them at a 45° angle to squeeze the workpiece into the corner between the upper table surface and the vertical face of its flange. Furthermore the guide rail itself can be used as a workpiece-holddown arm.

In accordance with the invention the table and shifter define an upper support surface on which the foodstuff rests and which is substantially parallel to the guide rail. The arm extends generally perpendicularly of the rail and surface. The formations include a sleeve loosely surrounding the rail so that the sleeve cants on the rail when the arm presses forward against the foodstuff to block movement of the arm in the reverse direction. This is an extremely simple and effective blocking structure. It works particularly well with a system where the drive includes a flexible element spanned between the motor and a point on the sleeve positioned such that when the motor operates to displace the arm in the reverse direction the sleeve is tipped such that it can slide on the rail.

According to a further feature of this invention the rail and arm carried thereon are pivotal about an axis generally parallel to the blade axis between a lowered position with the rail generally parallel and close to the table and a raised position with the rail projecting upward from the table. They are pivoted up for reloading of the slicing machine.

Furthermore according to the invention the drive includes a sensor that detects the current consumption of the motor and a power supply for feeding a relatively high voltage to the motor when the current consumption is relatively low or below a predetermined threshold and for reducing the voltage and feeding a relatively low voltage to the motor when the current consumption is relatively high or above this threshold so that when the arm stops and the motor is jammed the motor feed voltage is reduced. This provides a solid holding of the foodstuff without overheating the motor. In addition a sensor connected to the arm produces an output corresponding to the position of the arm relative to the table so that this output can be fed to an automatic output device that lays down the slices after is cut by the blade from the foodstuff.

BRIEF DESCRIPTION OF THE DRAWING

The above and other objects, features, and advantages will become more readily apparent from the following, reference being made to the accompanying drawing in which.

SPECIFIC DESCRIPTION

Figure 2:
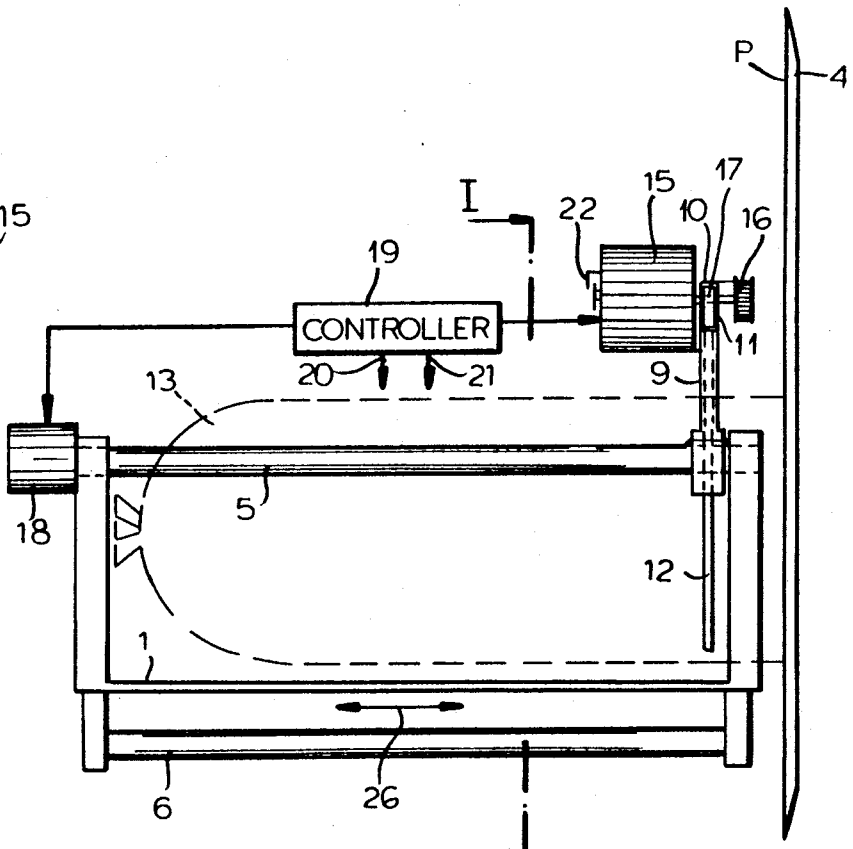
FIG. 2 is an end view of the machine.

As seen in the drawing a horizontal support table 1 having an upright end flange 14 can be reciprocated in the transverse direction shown by arrow 2 by a schematically illustrated electric drive motor 24 past a rotary blade 4 that forms with a vertical end abutment plate 3 a vertical support plane P perpendicular to the direction 2 and to the unillustrated blade axis. The table 1 carries upper and lower guide rods 5 and 6 that extend parallel to the unillustrated rotation axis of the disk blade 4 and to the direction 2. A carriage 7 supporting a pivotal holddown arm shown in dashed lines at 8 that is relatively remote from the blade plane P is slidable on these rods 5 and 6. A support tongue 23 overlying the table 1 and normally supporting at least one generally cylindrical foodstuff 13 is fixed on the carriage 7. A motor 25 is connected to the carriage 7 to periodically shift it axially in direction 26 to press the foodstuff 13 against the blade 4 and plate 3.

A T-shaped arm 9, 10 is fixed on the upper rod 5 immediately adjacent the plane P and has a upright leg 9 extending up from the rod 5 and a horizontal guide rail 10 that normally extends horizontally parallel to the direction 2. A motor 18 on the end of the rod 5 can rotate it about its axis to move the elements 9 and 10 between the solid-line illustrated lower position and the dashed-line upper position show at 9', 10'.

A sleeve 11 is slidable along the rail 10 and is a loose vertical fit thereon, that is it can cant on the rail 10 about a horizontal axis perpendicular to the longitudinal axis of the rail 10. It is integral with a holding arm 12 that in the lowered position of the rail 10 extends vertically, parallel to the support-table flange 14. One end of the rail 10 carries an electric motor 15 connected via a belt or chain 16 to a point 17 on the upper side of the sleeve 11. Rotation of the motor 15 in one direction moves the sleeve 11 and arm 12 outward from the dashed-line position 12' to the solid-line position engaging against the foodstuff 13 and pressing same against the support-table flange 14. In this position the sleeve 11 is canted so that it wedges and cannot readily be pushed oppositely back away from the flange. Nonetheless when the motor 15 is oppositely rotated the attachment location 17 is positioned such that this movement will first be transmitted to the sleeve 11 to square it on the rod 10, allowing it to be pulled back.

A controller 19 is connected to the motors 15 and 18 and also has outputs 20 and 21 connected to the actuators 24 and 25 to synchronize operation of the machine. Furthermore a position sensor 22 produces an output corresponding to the position of the arm 12 on the rod 10 and feeds it to an unillustrated output-side arraying device.

The device described above operates as follows:

To start with the motor 18 swings the rod 10 to the up position 10' while the motor 15 pulls the arm 12 back toward the carriage 7. Then the operator drops a foodstuff 13 to be sliced onto the table 1 atop the slide 23 with the end of the foodstuff 13 at the plane P.

The motor 18 then pivots the rod 10 down to the solid line position and the motor 15 advances the arm 12 until it engages the foodstuff 13 and presses it against the flange 14. Once the foodstuff 13 is solidly engaged with the flange 14, the sleeve 11 cants and wedges in place. At the same time the motor 15 is forcibly stopped so that a motor-current sensor of the controller 19, which powers this motor 15, senses the increased current draw and decreases the motor supply voltage, for instance from 24V to 12V, which keeps the arm 12 pushing against the foodstuff 13 but prevents the motor 15 from overheating.

Figure 1:
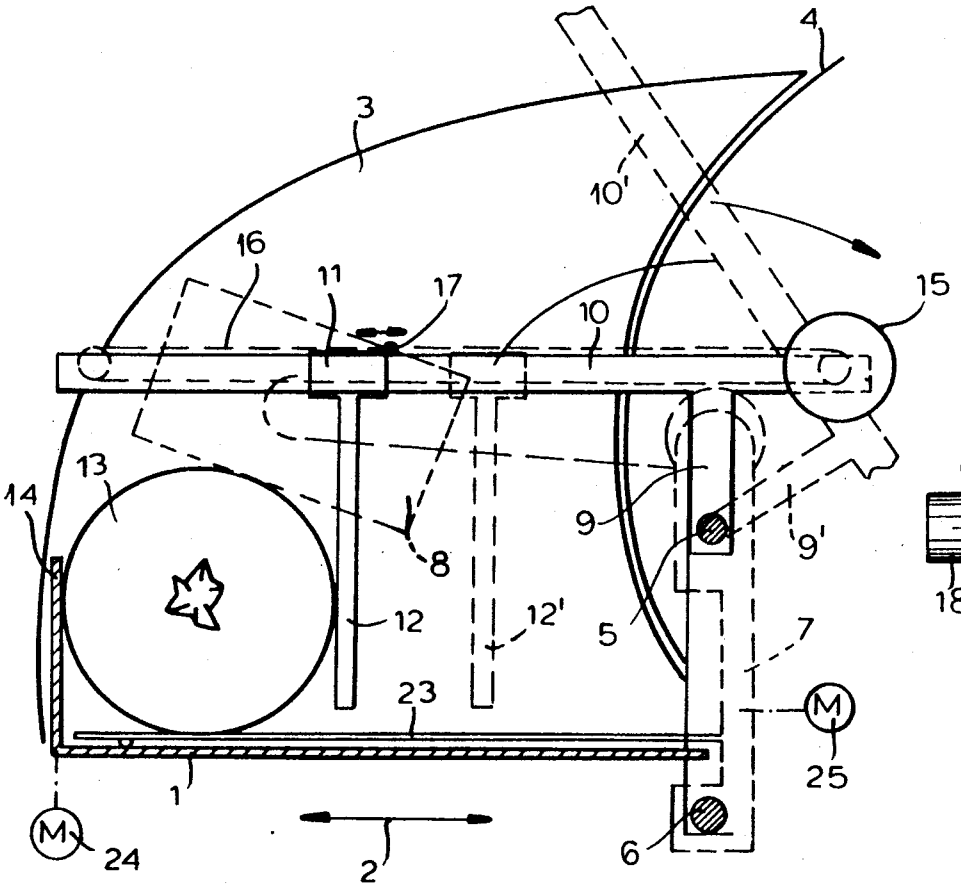
FIG. 1 is a section taken along line I—I of FIG. 2 through a slicing machine according to the invention.

The actuator 24 then reciprocates the table 1 forward (to the left in FIG. 1) in direction 2 past the blade 3 to cut a slice from the end of the foodstuff 13. A catch fork or the like on the unillustrated output side of the blade 3 catches the fresh slice and sets it on a plate.

Once the table 1 reaches its forward end position, the motors 24 and 25 are reversed. This moves the table 1 back (to the right in FIG. 1) in direction 2, unwedges the sleeve 11, and also pulls back the arm 12. The controller 19 then briefly actuates the motor 25 to step the slide 23 and workpiece 13 in the direction 26 toward the blade plane P and push the workpiece 13 against the plane P, whereupon the motor 15 is again reversed to reclamp the thus repositioned workpiece. The motor 24 then is reversed to cut a new slice in a new machine cycle.

When the entire workpiece 13 has been sliced, or, more accurately, when there is only a short stub left pinched by the arm 12, the rod 10 and arm 12 are again pivoted up by the motor 18. The operator can then replace the workpiece 13.

I claim:

1. An apparatus for cutting slices from a foodstuff, the apparatus comprising:

a support;

a blade on the support extending perpendicular to and rotatable about an axis;

a table adapted to support the foodstuff to be sliced and displaceable transversely of the axis past the blade;

means for reciprocating the table transversely of the axis past the blade;

means for shifting the foodstuff on the table axially toward the blade;

a guide rail extending transversely of the axis immediately adjacent the blade;

a holding arm engageable with the foodstuff on the table and displaceable along the rail in a forward direction to press the foodstuff against the table and in an opposite reverse direction;

interengaging formations on the rail and arm for preventing movement of the arm in the reverse direction on the guide rail; and drive means including an electric motor connected to the arm for displacing same on the rail in the forward direction and for disengaging the formations and displacing the arm on the rail in the reverse direction.

2. The slicing apparatus defined in claim 1 wherein the guide rail extends generally horizontally above the table and the holding arm projects downward from the guide rail.

3. The slicing apparatus defined in claim 2 wherein the table and shifting means define an upper support surface on which the foodstuff rests and which is substantially parallel to the guide rail, the arm extending generally perpendicularly of the rail and surface, the formations including a sleeve loosely surrounding the rail, whereby the sleeve cants on the rail when the arm presses forward against the foodstuff to block movement of the arm in the reverse direction.

4. The slicing apparatus defined in claim 3 wherein the drive means includes a flexible element spanned between the motor and a point on the sleeve positioned such that when the motor operates to displace the arm in the reverse direction the sleeve is tipped such that it can slide on the rail.

5. The slicing apparatus defined in claim 2, further comprising means for pivoting the rail and arm carried thereon about an axis generally parallel to the blade axis between a lowered position with the rail generally parallel and close to the table and a raised position with the rail projecting upward from the table.

6. The slicing apparatus defined in claim 1 wherein the drive means includes means for sensing the current consumption of the motor and means for feeding a relatively high voltage to the motor when the current consumption is relatively low and for reducing the voltage and feeding a relatively low voltage to the motor when the current consumption is relatively high, whereby when the arm stops and the motor is jammed the motor feed voltage is reduced.

7. The slicing apparatus defined in claim 1, further comprising control means connected to the drive means and shifting means for reverse displacing the holding arm during shifting of the foodstuff toward the blade.

8. The slicing apparatus defined in claim 1, further comprising sensor means connected to the arm for producing an output corresponding to the position of the arm relative to the table, whereby this output can be fed to an automatic output device that lays down the slices after being cut by the blade from the foodstuff.

9. An apparatus for cutting slices from a foodstuff, the apparatus comprising:

a support;

a blade on the support extending perpendicular to and rotatable about an axis;

a table adapted to support the foodstuff to be sliced and displaceable transversely of the axis past the blade;

means for reciprocating the table transversely of the axis past the blade;

means for periodically shifting the foodstuff on the table axially toward the blade;

a guide rail extending transversely of the axis immediately adjacent the blade;

a holding arm engageable with the foodstuff on the table and displaceable along the rail in a forward direction to press the foodstuff against the table and in an opposite reverse direction; interengaging formations on the rail and arm for preventing movement of the arm in the reverse direction on the guide rail;

drive means including an electric motor connected to the arm for displacing same on the rail in the forward direction and for disengaging the formations and displacing the arm on the rail in the reverse direction; and control means connected to the drive and shifting means for reverse displacing the holding arm during shifting of the foodstuff toward the blade.

* * * * *